US007306404B2

(12) United States Patent
Torgersen

(10) Patent No.: US 7,306,404 B2
(45) Date of Patent: Dec. 11, 2007

(54) DEVICE AND A METHOD FOR WELL INTERVENTION

(76) Inventor: Kjell Inge Torgersen, Krokusveien 2A, N-4316 Sandnes (NO)

( * ) Notice: Subject to any disclaimer, the term of this patent is extended or adjusted under 35 U.S.C. 154(b) by 135 days.

(21) Appl. No.: 11/274,426

(22) Filed: Jan. 20, 2006

(65) Prior Publication Data

US 2006/0102356 A1 May 18, 2006

(51) Int. Cl.
*E21B 29/12* (2006.01)

(52) U.S. Cl. ..... 405/224.4; 166/355

(58) Field of Classification Search ..... 405/224.2, 405/224.4; 166/355
See application file for complete search history.

(56) References Cited

U.S. PATENT DOCUMENTS 3,791,628 A * 2/1974 Burns et al. ..... 254/277
3,834,672 A * 9/1974 Hawley et al. ..... 254/392
4,395,160 A * 7/1983 deJong ..... 405/224.4
6,708,765 B1 * 3/2004 Eilertsen ..... 405/224.4
7,219,739 B2 * 5/2007 Robichaux ..... 166/355

* cited by examiner

*Primary Examiner*—Frederick L. Lagman
(74) *Attorney, Agent, or Firm*—Proskauer Rose LLP

(57) ABSTRACT

A handling device for well intervention, the handling device being releasably connected, in an operative position, to a riser and to a heave compensator which is arranged to maintain a prescribed tensioning of the riser. The handling device comprising: a lower riser securing device; a substantially vertical tensioning frame provided with at least two parallel guides; a jacking table provided with an upper riser securing device; at least one tension-resistant connection between the tensioning frame and the heave compensator located thereabove; the jacking table being movably connected to the at least two parallel guides, at least one of the at least two parallel guides including lifting screws for moving the jacking table along the guides in their, in the position of use, vertical extent, and the jacking table including hydraulic cylinders for moving the upper riser securing device in a horizontal direction along at least one axis of movement.

14 Claims, 8 Drawing Sheets

DEVICE AND A METHOD FOR WELL INTERVENTION

The invention relates to a device and a method for well intervention, especially intervention in an offshore hydrocarbon well, in which a riser extending up above the drill floor of a floating installation for exploration and/or production drilling for hydrocarbons, is kept tensioned by the lower gripping device of a handling device holding the riser in a firm grip at the lower edge of a portion which is suitable for intervention operations, whereby the riser is kept tensioned by a device suitable therefore, for example a heave compensator, which is connected to the handling device. By means of the jacking table and lifting devices of the handling device, riser sections and tools are disconnected, moved and connected to the riser.

In offshore well interventions a connection must be established between a well installation on the sea floor and an exploration/production unit on the sea surface in the form of a riser with associated valves, pressure barriers and so on. The intervention is carried out essentially by running tools of appropriate kinds into the riser and further down into the well. Normally, in such operations, one or more riser sections/valve sections must be connected/disconnected and well tools be locked into and out of the riser. In the prior art, pulley blocks or similar are used to a great extent to handle the section(s) to be connected to or disconnected from the riser. In some instances very heavy loads suspended by straps, represent a great hazard to the operators on and at the drill floor, especially when wind and rolling make the hanging loads swing.

The invention has as its object to remedy or reduce at least one of the drawbacks of the prior art.

The object is achieved through the features specified in the description below and in the subsequent Claims.

For connection to a well intervention riser and a heave compensator, for example in the form of a drill string compensator known in itself, a handling device is arranged for transferring tensile and lifting force between the heave compensator and the riser. The handling device includes a lower riser securing device arranged to clamp in a releasable manner a portion of the riser, for example immediately below a blowout preventer (BOP) at the upper portion of the riser. Further, the handling device includes a tensioning frame with one or more guides for a jacking table, the guides standing substantially vertically in a position of use. The jacking table is connected with the guides by means of means for moving the jacking table in the vertical extent of the guides. The jacking table also includes an upper riser securing device and means for moving the upper riser securing device in the horizontal longitudinal and transversal directions of the jacking table. Further, the handling device includes at least one connection between the tensioning frame and a heave compensator located thereabove, the connection capable of withstanding tensile load.

The means for moving the jacking table in a vertical direction, advantageously include one or more devices for blocking the movement.

The means for moving the upper riser securing device in a horizontal direction advantageously also include one or more devices for blocking the movement.

The at least one tension-resistant connection between the tensioning frame and heave compensator is advantageously connected to the heave compensator by means of an upper beam.

The upper beam is suitably provided with at least one lifting device for handling a well tool.

The at least one lifting device of the upper beam is advantageously a pulley block.

The at least one tension-resistant connection is advantageously a tie rod.

Advantageously, the lower and upper riser securing devices are separately complementary to one or more riser portions, which are arranged to receive a compressive force directed radially inwards and an axial tensile force.

The means for moving the jacking table in a vertical direction and their devices for blocking the movement, and the means for moving the upper gripping device in a horizontal direction and their devices for blocking the movement, are advantageously arranged for remote operation.

The lower and upper gripping devices are suitably arranged for remote operation.

The handling device advantageously includes one or more working platforms.

The invention also relates to a method for well intervention, in which a handling device according to the invention is releasably connected, in an operative position, to a riser and to a heave compensator which is arranged to maintain a prescribed tension in the riser, the method comprising the steps of:

establishing a riser between an area immediately above the well installation on the sea floor and the drill floor of a drilling vessel, the upper riser portion extending up through the drill floor, securing the riser to the drill floor, connecting the handling device and a heave compensator acting above the drill floor, connecting the handling device and the upper riser portion by lowering the handling device towards the riser and attaching a lower riser securing device to the riser, lifting the heave compensator as the drill string is released from the drill floor, lowering the riser into contact with the well installation on the sea floor and connecting it thereto, lifting one or more riser sections, one by one or joined, by means of a lifting device until a portion of the riser section(s) suitable for clamping is located at a jacking table arranged in the handling device, moving an upper riser securing device arranged in the jacking table into clamping engagement with the riser section(s), releasing the riser section(s) from the lifting device, and lowering the riser section(s) towards the riser clamped by the lower riser securing device of the handling device, by moving the jacking table along the vertical guides of the handling device, after which the riser section(s) is (are) connected to the riser and released from the upper riser securing device.

The method advantageously includes the locating of the lifting device in an upper beam arranged in the handling device.

The method further includes insertion of one or more tools into the riser, the tool(s) being put into place in the riser by means of the lifting device.

In what follows, is described a non-limiting example of a preferred embodiment which is visualized in the accompanying drawings, in which:

FIG. 6 shows the lower part of the tensioning frame on a larger scale, in which a cover above the lower riser securing device is partially cut through;

Figure 1:
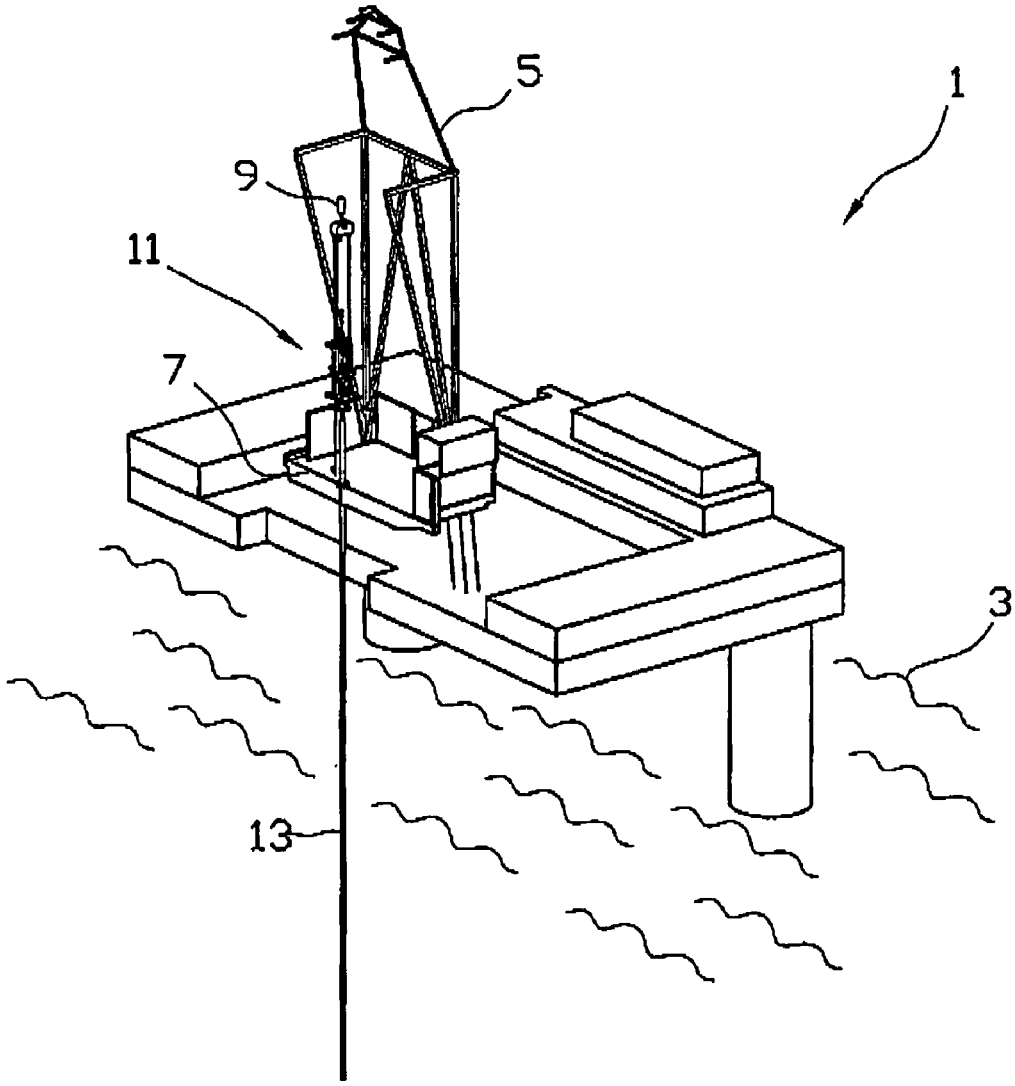
FIG. 1 shows a perspective sketch of parts of a floating installation offshore with a cutaway drilling derrick and a riser with a handling device according to the invention.
Figure 2:
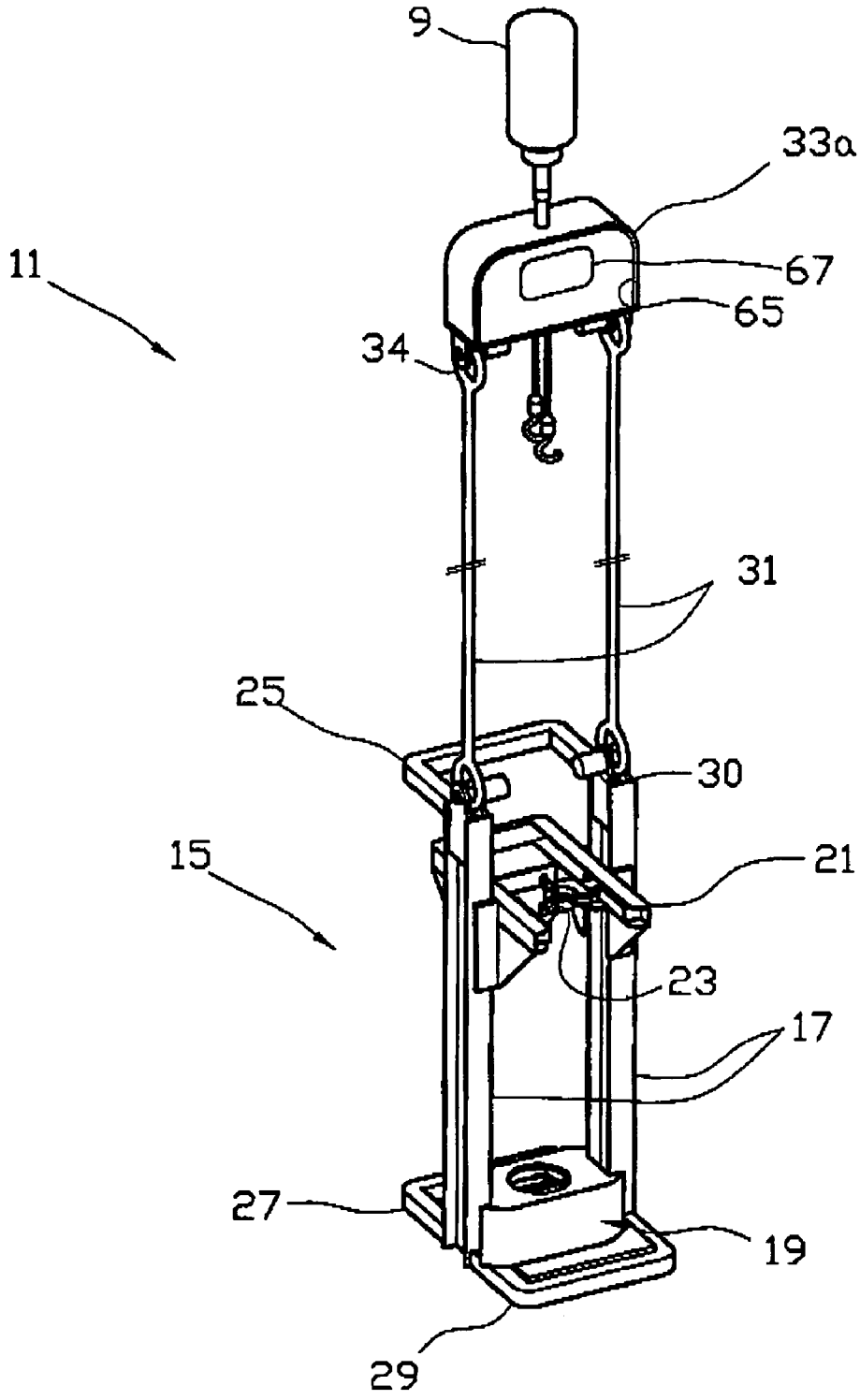
FIG. 2 shows, on a larger scale, a handling device according to the invention.
Figure 3:
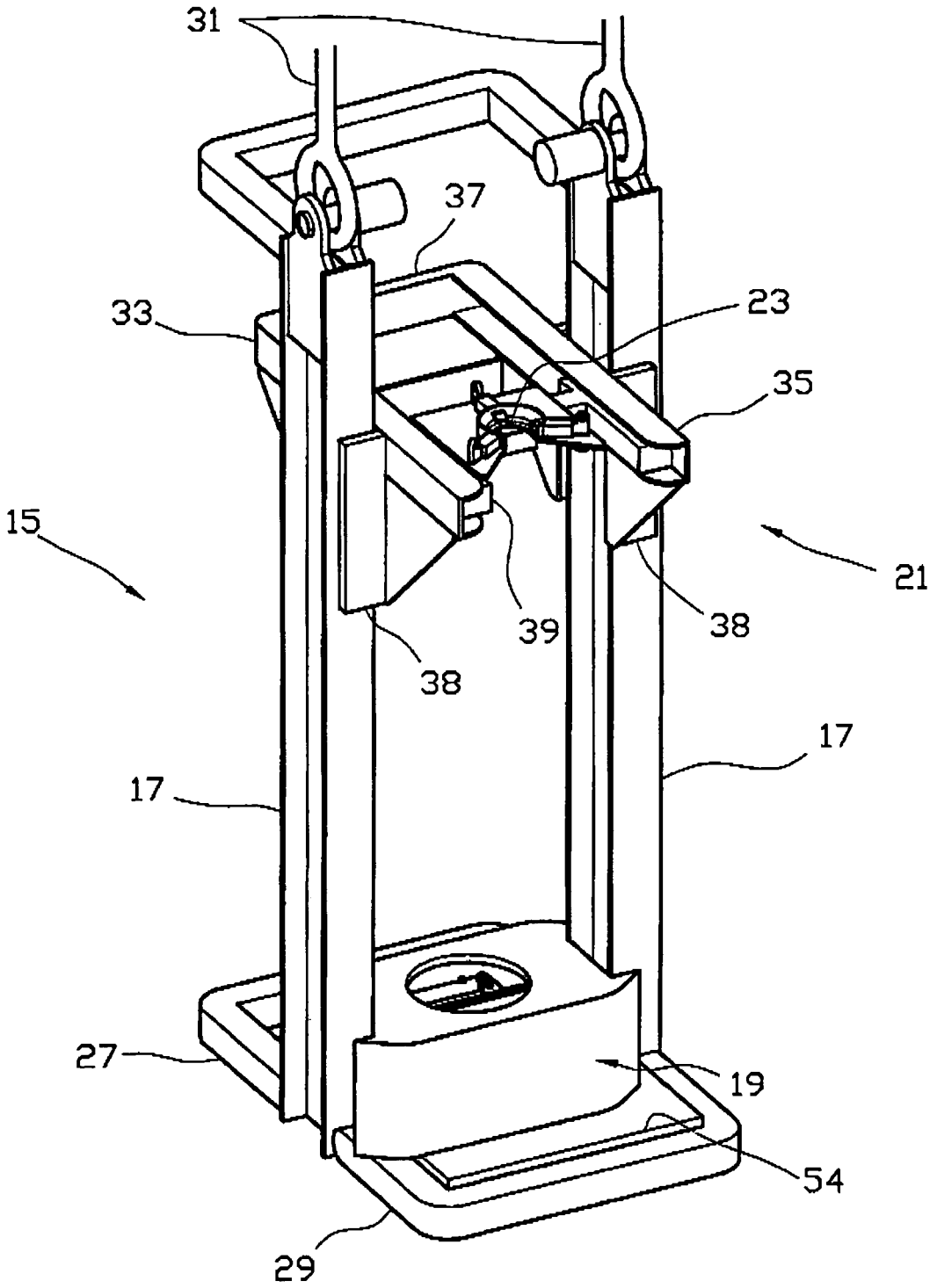
FIG. 3 shows, on a larger scale, a tensioning frame with a jacking table, lower and upper riser securing devices and a working platform.
Figure 4:
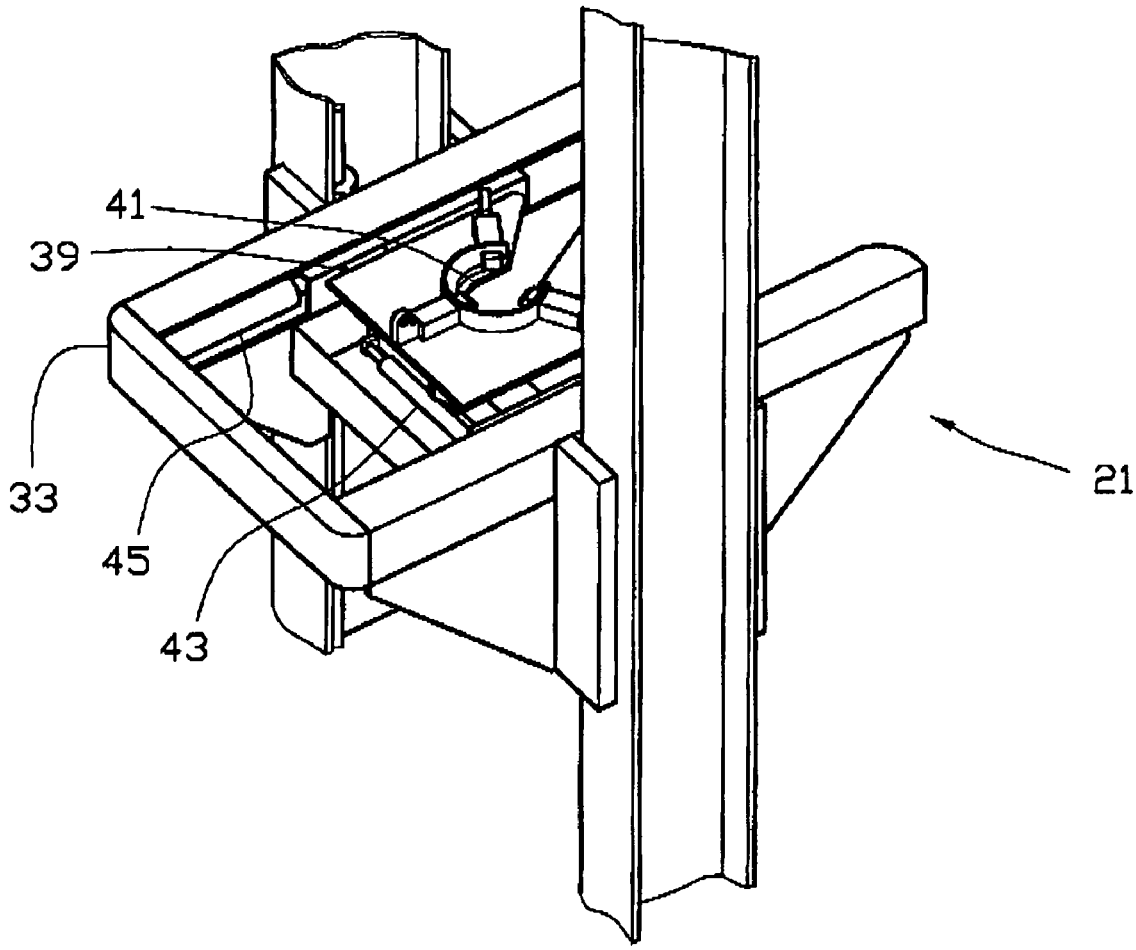
FIG. 4 shows the jacking table on a larger scale.
Figure 5:
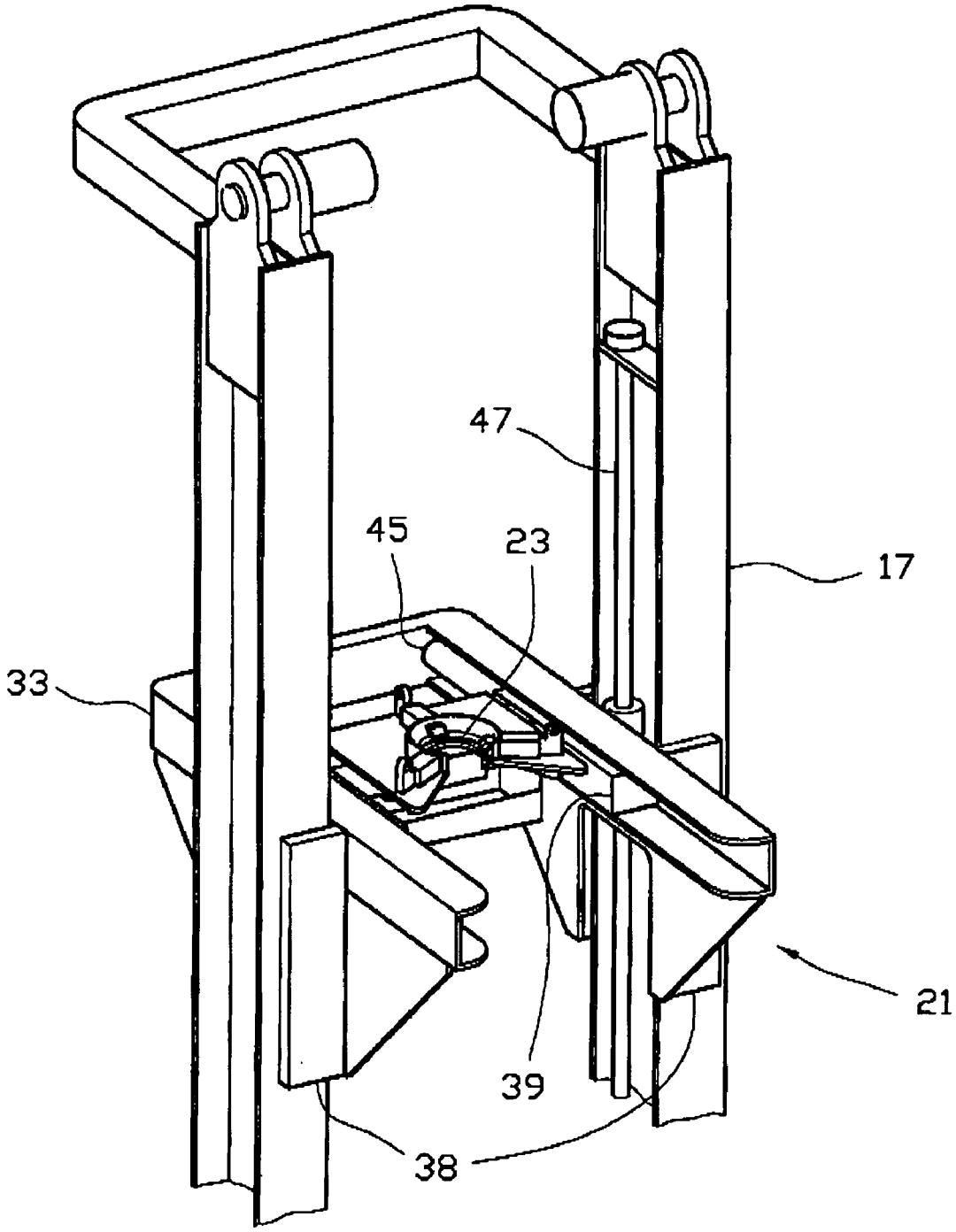
FIG. 5 shows the jacking table at another angle than that of FIG. 4.
Figure 6:
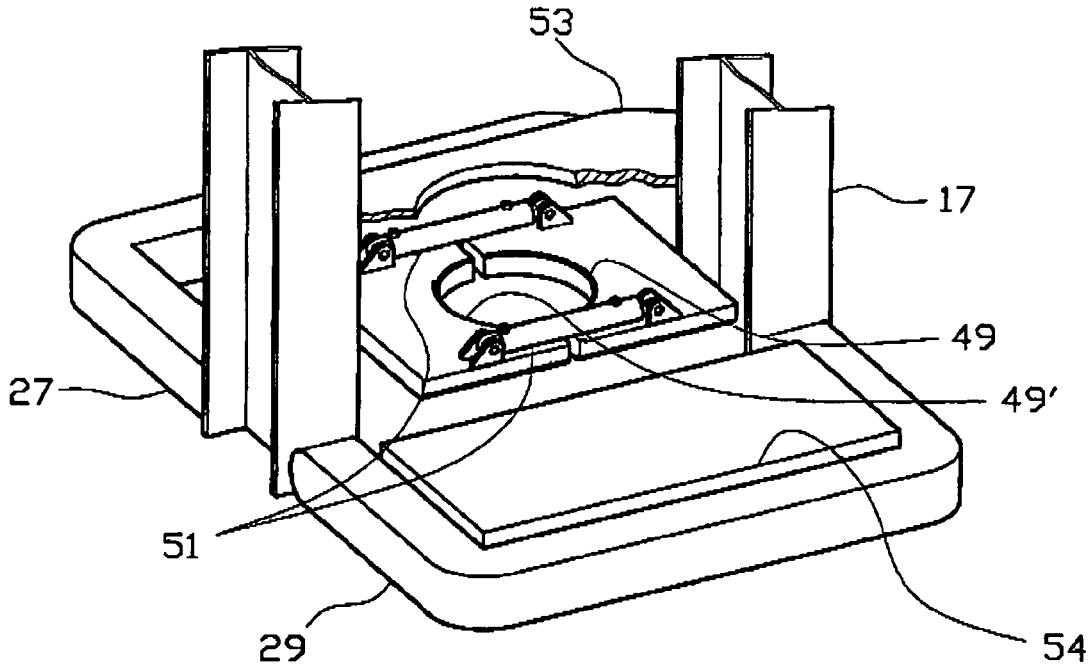
Figure 7:
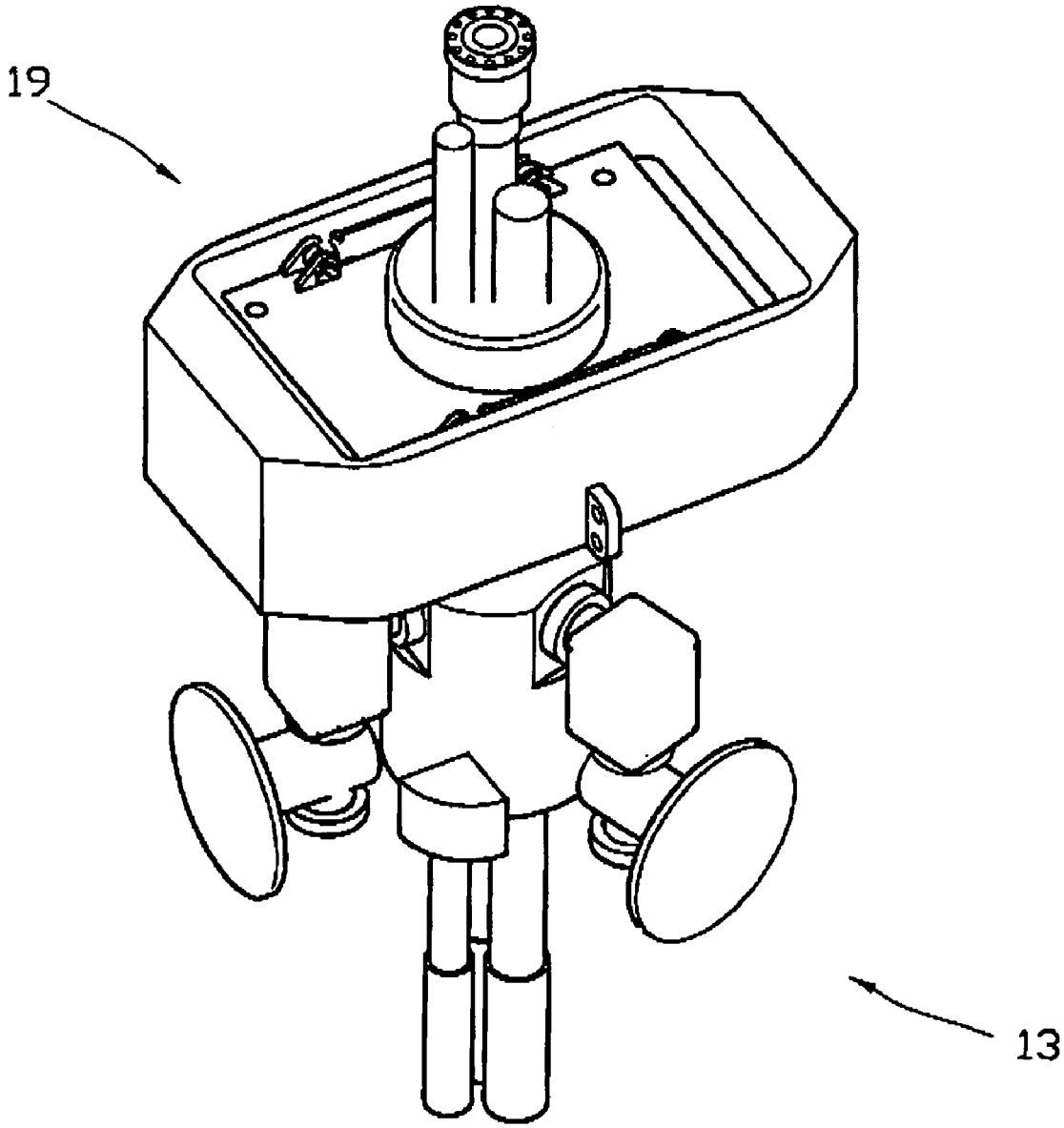
FIG. 7 shows, on approximately the same scale, the riser securing device provided with a cover, the cover enclosing an upper portion of the riser.
Figure 8:
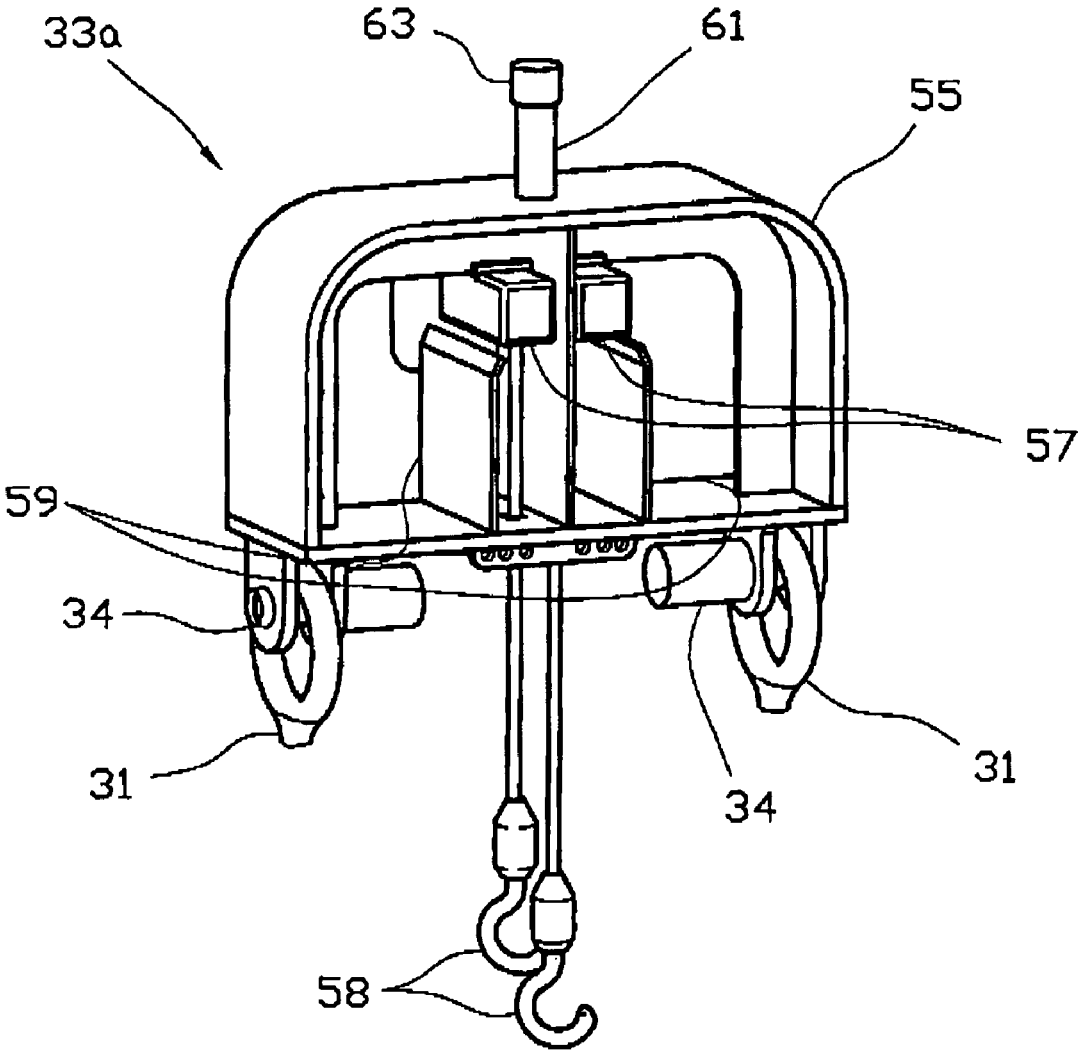
FIG. 8 shows, on a smaller scale, an upper beam with two lifting devices, the front cover having been removed.

In FIG. 1 the reference numeral 1 indicates a floating installation (here shown cut through) for exploration or production drilling for hydrocarbons, while floating in a known manner, partially submerged below a sea surface 3. The installation 1 is provided with a drilling derrick 5 (here shown cut through), a drill floor 7, a drill string drive 9, which is movably secured, in a known manner, to the drilling derrick 5 and installation 1 by means of a heave-compensating system, the drill string drive and the heave-compensating system being referred to below as a heave compensator having the reference numeral 9. A handling device 11 is connected to a riser 13. The riser 13 continues down into the body of water and is connected with a well (not shown) on the sea floor (not shown).

Referring hereafter mainly to FIGS. 2-8, the handling device 11 is provided with a tensioning frame 15 including two vertical, parallel guides 17, a lower riser securing device 19, a jacking table 21 with an upper riser securing device 23, upper and lower frame connections 25, 27, 29 and two lifting rod attachments 30. Further, the handling device 11 includes two lifting rods 31 (called bails by persons skilled in the art) and an upper beam 33*a* with two lifting rod attachments 34. The lifting rods 31 with the lifting rod attachments 30, 34 constitute per se prior art.

The jacking table 21 includes a table frame 33 formed substantially by two horizontal, parallel beams 35 and a cross beam 37. Two side supports 38 are rigidly connected to the beams 35 of the table frame 33, are complementary to the guides 17 of the tensioning frame 15 and are arranged to slide along the guides 17. An approximately H-shaped shuttle frame 39 is slidingly supported in the beams 35. The upper riser securing device 23 is slidingly supported on the shuttle frame 39. The jacking table 21 is provided with a hydraulic cylinder 43 for moving the riser securing device 23 on the shuttle frame 39 and two hydraulic cylinders 45 for moving the shuttle frame 39 in the table frame 33 (see FIG. 4). The hydraulic cylinders 43, 45 are connected to a hydraulic system (not shown) known per se, which includes a driving motor, pump, valves and oil-carrying conduits, suitably including locking valves and hose rupture valves.

The guides 17 are each provided with a lifting screw 47 (see FIG. 5) which are rotated in parallel by a hydraulic motor (not shown) and include means for locking the movement, in the manner fully described in Norwegian patent No 314361. The lifting screws 47 are connected to the jacking table 21 for vertical movement of the jacking table 21 along the guides 17.

The lower riser securing device 19 includes two gripping sections 49, 49', which are slidingly supported on a supporting frame (not shown) and are movable relative to each other as they are connected by means of two hydraulic s cylinders 51. The hydraulic cylinders 51 are connected to a hydraulic system (not shown) known per se, which includes a driving motor, pump, valves and oil-carrying conduits, appropriately including locking valves and hose rupture valves. The lower riser securing device 19 is provided with a cover 53.

The tensioning frame 15 is provided with a working platform 54.

The upper beam 33*a* is formed as a housing 55 accommodating two pulley blocks 57, each with a hook 58 and associated chain housing 59. In addition to the lifting rod attachments 34, the upper beam 33*a* is also provided with a tubular upper attachment 61 having a threaded portion 63, which is suitable for connection to the heave compensator 9. The upper beam 33*a* is also provided with a side cover 65 and inspection cover 67 (see FIG. 2).

In well intervention a riser 13 is assembled in a manner known per se, the riser 13 being hung up in the drill floor 7 and lowered successively towards the well as new pipe sections are joined thereto. As the lower end portion of the riser 13 has reached a position just above the well installation on the sea floor, the handling device 11 is used to release the riser 13 from the drill floor 7 and connect the riser 13 to the heave compensator 9, in order, thereby, to lower the riser 13 into connection with the well installation in a controlled movement without it being influenced by movement of the floating installation 1 caused by wind and waves.

The handling device 11 is connected to the heave compensator 9 and raised to a vertical hanging position above the drill floor 7. The handling device 11 is lowered over the riser 13 until the lower riser securing device 19 is slid down over the upper end portion of the riser 13. The gripping sections 49, 49' are moved by means of hydraulic pressure in the cylinders 51 towards each other into a clamping grip about the riser 13. The handling device 11 is raised or lowered by means of the heave compensator 9 to give the riser 13 the prescribed position or tensile load.

A riser section which is then to be joined to the riser 13, for example a blowout preventer (BOP) or a section which is suitable for the insertion of tools, for example a stuffing box (lubricator), is connected to one of the pulley blocks 57 via one of the hooks 58 and lifted in an upright position up to the jacking frame 21, where the riser section is gripped by the upper riser securing device 23, this being positioned by the hydraulic cylinders 43, 45 and lifting screws 47 of the jacking table 21. Next, the riser section is positioned on the riser 13 clamped in the lower riser securing device 19, by means of the controlled movements of the jacking table 21 and is then connected to the riser 13.

Tools, which, for example, are to be inserted into the riser 13 for well intervention, are lifted and positioned by means of the pulley blocks 57.

When breaking out riser sections or removing well tools the operations are carried out in the reverse order.

The moving of riser sections is suitably carried out by means of remote control of the pulley blocks 57 and jacking table 21. After a riser section or a tool has been positioned, the personnel performing the well intervention, may carry out manual operations from the working platform 54 of the tensioning frame 15. Relative to so-called wire line operations in well interventions according to the prior art, a reduced risk is thereby achieved for personnel involved in the well intervention, since the personnel may avoid working below a hanging load. The risk is further reduced by the supporting of the heavy riser sections in a firm grip in the handling device 11, so that it is not necessary to work close to a hanging load which may be set into swinging motion due to the influence of waves and sea currents on the installation 1 or due to wind on the drill floor 7.

It is evident that the invention is not limited only to the clamping of the drill string 13 and drill string sections by riser securing devices of the kind described here, but is applicable to any kind of riser securing devices, manually operated or remotely operated, integrated into a handling device according to the invention.

The invention claimed is:

1. A handling device (11) for well intervention, the handling device (11) being releasably connected, in an operative position, to a riser (13) and to a heave compensator (9) which is arranged to maintain a prescribed tensioning of the riser (13), characterized in that the handling device (11) comprises:

a lower riser securing device (19), a substantially vertical tensioning frame (15) provided with at least two parallel guides (17), a jacking table (21) provided with an upper riser securing device (23), at least one tension-resistant connection (31) between the tensioning frame (15) and the heave compensator (9) located thereabove, the jacking table (21) being movably connected to the at least two parallel guides (17), at least one of the at least two parallel guides (17) including means (47) for moving the jacking table (21) along the guides (17) in their, in the position of use, vertical extent, and the jacking table (21) including means (43, 45) for moving the upper riser securing device (23) in a horizontal direction along at least one axis of movement.

2. The device in accordance with claim 1, characterized in that the means (47) for moving the jacking table (21) in a vertical direction is formed by one or more devices for blocking the movement.

3. The device in accordance with claim 1, characterized in that the means (43, 45) for moving the upper gripping device (23) in a horizontal direction, is formed by one or more devices for blocking the movement.

4. The device in accordance with claim 1, characterized in that the at least one tension-resistant connection (31) between the tensioning frame (15) and the heave compensator (9) is connected to the heave compensator (9) by means of an upper beam (33*a*).

5. The device in accordance with claim 4, characterized in that the upper beam (33*a*) is provided with at least one lifting device (57) for handling a well tool.

6. The device in accordance with claim 4, characterized in that the upper beam (33*a*) is provided with at least one lifting device (57) for handling a well tool, and that the at least one lifting device is formed by a pulley block.

7. The device in accordance with claim 1, characterized in that the at least one tension-resistant connection (31) is formed by a tie rod.

8. The device in accordance with claim 1, characterized in that the lower and upper riser securing devices (19, 23) are separately complementary to one or more riser portions which are arranged to receive a compressive force directed radially inwards and an axial tensile force.

9. The device in accordance with claim 1, characterized in that the means for moving the jacking table (21) in a vertical direction and their devices for blocking the movement, and the means for moving the upper gripping device (23) in a horizontal direction and their devices for blocking the movement, are arranged for remote operation.

10. The device in accordance with claim 1, characterized in that the lower and upper riser securing devices (19, 23) are arranged for remote operation.

11. The device in accordance with claim 1, characterized in that the handling device is provided with one or more working platforms (54).

12. A well intervention method in which a handling device (11) according to claim 1 is releasably connected, in an operative position, to a riser (13) and to a heave compensator (9) which is arranged to maintain a prescribed tensioning of the riser (13), characterized in that the method comprises the steps of:

establishing a riser (13) between an area immediately above the well installation on the sea floor and the drill floor (7) of a drilling installation (1), an upper riser portion extending up through the drill floor (7), securing the riser (13) to the drill floor (7), connecting the handling device (11) and an effective heave compensator (9) located above the drill floor, connecting the handling device (11) and the upper riser portion by lowering the handling device (11) towards the riser (13) and attaching a lower riser securing device (19) to the riser (13), lifting the heave compensator (9) as the drill string (13) is released from the drill floor (7), lowering the riser (13) into contact with the well installation on the sea floor and connecting it thereto, lifting one or more riser sections, one by one or joined, by means of a lifting device (57) until a portion of the riser section(s) suitable for clamping is located at a jacking table (21) arranged in the handling device (11), moving an upper riser securing device (23) arranged in the jacking table (21) into clamping engagement with the riser section(s), releasing the riser section(s) from the upper lifting device (23), and lowering the riser section(s) towards the riser (13) clamped by the lower riser securing device (19) of the handling device (11), by moving the jacking table (21) along the vertical guides (17) of the handling device (11), after which the riser section(s) is (are) connected to the riser (13) and released from the upper riser securing device (23).

13. The method in accordance with claim 12, characterized in that the lifting device (57) is arranged in an upper beam (33*a*), which is arranged in the handling device (11).

14. The method in accordance with claims 12 and 13, characterized in that the method further includes the insertion of one or more tools into the riser (13), the tool/tools being put into place in the riser (13) by means of the lifting device (57).

* * * * *